US010014632B2

(12) United States Patent
Soos

(10) Patent No.: US 10,014,632 B2
(45) Date of Patent: Jul. 3, 2018

(54) ELECTRICAL CONNECTOR FOR CONNECTING EXTERNAL DEVICE TO DRAW POWER FROM POWER SOURCE FOR VIDEO CAMERA

(71) Applicant: 1593563 Ontario Inc., Toronto (CA)

(72) Inventor: Emery Tibor Soos, Pickering (CA)

( * ) Notice: Subject to any disclaimer, the term of this patent is extended or adjusted under 35 U.S.C. 154(b) by 243 days.

(21) Appl. No.: 14/700,691

(22) Filed: Apr. 30, 2015

(65) Prior Publication Data

US 2016/0020556 A1 Jan. 21, 2016

Related U.S. Application Data

(60) Provisional application No. 62/025,556, filed on Jul. 17, 2014.

(51) Int. Cl.
*H01R 13/641* (2006.01)
*H01R 13/66* (2006.01)
(Continued)

(52) U.S. Cl.
CPC ..... *H01R 13/641* (2013.01); *H01R 13/665* (2013.01); *H01R 13/6658* (2013.01); *H01R 13/7175* (2013.01); *H01R 13/6666* (2013.01)

(58) Field of Classification Search
CPC H01R 13/641; H01R 13/665; H01R 13/6658; H01R 13/7175; H01R 13/6666;
(Continued)

(56) References Cited

U.S. PATENT DOCUMENTS 2,474,407 A * 6/1949 Todd ..... G01R 19/14 324/133
6,104,866 A 8/2000 Dewitt et al.
(Continued)

FOREIGN PATENT DOCUMENTS

DE 202006002606 U1 * 4/2006 ..... H01M 2/20
EP 2234220 A1 9/2010
JP H0729613 A 1/1995

OTHER PUBLICATIONS (Anton Bauer® PowerTap Kit [online]. antonbauer.com [retrieeved on Dec. 30, 2014]). Retrieved from internet: <URL:http://www.antonbauer.com/dam/jcr:9ca5c21d-74d5-4196-9fae-eaa0d101037d/80750087%20%20Rev%20G%20%20WEB_Installation%20PowerTap%20Kit-.pdf>.*
(Continued)

*Primary Examiner* — Thienvu Tran
*Assistant Examiner* — Nicolas Bellido
(74) *Attorney, Agent, or Firm* — Millman IP Inc.

(57) ABSTRACT

In an aspect, a kit of parts for an electrical connector, which includes a plurality of housing portions, a first male terminal and a second male terminal, and an output device. The plurality of housing portions are mateable together to form a housing. The printed circuit board positionable in the housing. The male terminals are connected to the printed circuit board and are positioned to connect to an electrical power source. The output device is connected to the printed circuit board. The printed circuit board is connectable to an electrical conduit and is configured to electrically connect the electrical conduit to the male terminals, and contains a microprocessor that is programmed to indicate via the output device at least one property of a circuit formed with the electrical connector and the electrical power source.

7 Claims, 13 Drawing Sheets

(51) Int. Cl.

| | |
|---|---|
| ***H01R 13/717*** | (2006.01) |
| ***H01R 12/51*** | (2011.01) |
| ***H01R 13/512*** | (2006.01) |
| ***H01R 13/502*** | (2006.01) |
| ***H01R 13/58*** | (2006.01) |
| ***H01R 24/60*** | (2011.01) |
| ***H02H 11/00*** | (2006.01) |
| ***H02J 7/00*** | (2006.01) |

(58) Field of Classification Search

CPC ..... H01R 12/51; H01R 13/512; H01R 13/58; H01R 13/502; H01R 13/64; H01R 13/66; H01R 13/717; H01R 24/60; H02H 11/00; H02J 7/00

USPC ..... 361/79; 439/502, 189, 500, 504, 138, 439/677

See application file for complete search history.

(56) References Cited

U.S. PATENT DOCUMENTS

| | | | | |
|---|---|---|---|---|
| 6,220,872 | B1 | 4/2001 | Chen | |
| 6,259,170 | B1 | 7/2001 | Limoge et al. | |
| 7,632,134 | B2 | 12/2009 | Su et al. | |
| 2002/0022935 | A1* | 2/2002 | Murphy | H04L 12/10 702/60 |
| 2008/0096429 | A1 | 4/2008 | Mikolajczak et al. | |
| 2009/0141412 | A1* | 6/2009 | Hickam | H02H 3/14 361/54 |
| 2009/0156062 | A1 | 6/2009 | Reed et al. | |
| 2010/0279532 | A1* | 11/2010 | Inage | H01R 13/641 439/188 |
| 2011/0136350 | A1* | 6/2011 | Palli | H01R 13/6205 439/39 |

OTHER PUBLICATIONS (Welleen D-TAP DTAP Plug for DSLR Rig cable Ues to Anton Bauer Battery [online]. welleen.com [retrieeved on Jun. 25, 2013]). Retrieved from internet: <URL:http://www.welleen.com/index.php?_m=mod_product&_a=view&p_id=1060>.*

(Anton Bauer® 2012 Product Catalog [online]. megahertz.co.uk [retrieeved on Apr. 13, 2012]). Retrieved from internet: <URL:http://www.megahertz.co.uk/misc/download/dkDiTxYr918yC2sT>.*

(Anton Bauer® PowerTap Kit [online]. antonbauer.com [retrieeved on Dec. 30, 2014]). Retrieved from internet: <URL:http://www.antonbauer.com/dam/jcr:9ca5c21d-74d5-4196-9fae-eaa0d101037d/80750087%20%20Rev%20%20%20WEB_Installation%20PowerTap%20Kit-.pdf>.*

GB1507745.6, Search Report, dated Sep. 17, 2015, UK IPO.

EP15177307, Partial European Search Report, dated Oct. 20, 2015, EPO.

EP15177307, European Search Report, dated Apr. 1, 2016, EPO.

EP15177307.4, European Search Report, dated Feb. 20, 2017, EPO.

* cited by examiner

ELECTRICAL CONNECTOR FOR CONNECTING EXTERNAL DEVICE TO DRAW POWER FROM POWER SOURCE FOR VIDEO CAMERA

CROSS-REFERENCE TO RELATED APPLICATIONS

This application claims the benefit of, U.S. Patent Application No. 62/025,556, filed Jul. 17, 2014, the contents of which are incorporated herein by reference in their entirety.

FIELD

The present disclosure relates to electrical connectors, and more particularly to electrical connectors for connecting additional electrical loads to draw power from a power source for a video camera used in the filmmaking industry.

BACKGROUND

In the filmmaking industry, it is common to provide a connection port on a video camera that permits external electrical devices (i.e. devices aside from the video camera itself) to draw power from the video camera's battery pack. A typical connection port on a video camera is sometimes referred to as an Anton Bauer™ connection port. Connectors that are configured to mate with the Anton Bauer™ connection port may be referred to as Anton Bauer™ connectors, or Anton Bauer™ P-taps, or D-taps. The Anton Bauer™ connection port employs two female terminals which are surrounded by a D-shaped surround that is intended to receive a connector with two male terminals and a D-shaped lip that mates with the D-shaped surround. The D-shaped surround and lip are intended to permit P-taps to connect to the female terminals in only one way, so that the current flow to an external device at the other end of the connector occurs only in a selected flow direction. This helps to prevent a situation where the current flow is in the opposite direction to that required by the external device, which can damage certain types of devices. However, it has been found that the D-shaped surround and lip are sufficiently close to being rectangular that it is possible in some circumstances, for the D-shaped lip to be inserted onto the D-shaped surround the wrong way, potentially leading to damage of the device connected to the other end of the connector.

In addition, a number of companies supply the P-taps in the form of a kit of parts, thereby permitting a purchaser to manufacture their own connector assembly with an Anton Bauer™ connector at one end, an electrical cable leading from it, and either an electrical device directly connected to the other end of the cable, or another type of connector at the other end of the cable for connection to an electrical device. For example, a Lightning™ connector can be provided at the other end of the cable, so as to permit connection to an iPhone™ by Apple, Inc., of Cupertino, Calif., USA, thereby permitting charging of the device using power from the battery pack on the video camera. However, to form the Anton Bauer™ connector from the kit of parts and to connect an end of an electrical cable to it can be time consuming and relatively difficult. Additionally, it is relatively easy for errors to be made in assembling the connector, leading to short circuits, polarity reversal, or other problems.

There is consequently a need for a connector that connects to an Anton Bauer™ connection port that addresses at least one of these and/or other shortcomings in existing designs.

SUMMARY

This section provides a general summary of the disclosure, and is not a comprehensive disclosure of its full scope or all of its features.

In one aspect, a kit of parts for an electrical connector is provided, which includes a group of housing portions, and a plurality of male terminals. The group of housing portions are mateable together to form a housing having a first side and a second side. The group of housing portions has a first breakaway member and a second breakaway member mounted thereto. The first and second breakaway members are selectively separable from the housing portions to selectively form first and second apertures on the first and second sides of the housing respectively. The first and second apertures each are sized to permit an electrical conduit to extend between an interior of the housing and an exterior of the housing. The plurality of male terminals are positionable in the housing for forming an electrical connection to the electrical conduit.

Optionally, the group of housing portions includes a first housing portion and a second housing portion. The first housing portion has the first and second breakaway members connected thereto, and the second housing portion has third and fourth breakaway members connected thereto, which are selectively separable from the second housing portion to form third and fourth apertures. The first and third breakaway members are positioned to be separable from the first and second housing portions respectively so as to form a first enlarged aperture when the housing portions mate together to form the housing. The second and fourth breakaway members are positioned to be separable from the first and second housing portions respectively so as to form a second enlarged aperture when the housing portions mate together to form the housing.

In another aspect, a kit of parts for an electrical connector is provided, which includes a plurality of housing portions, a plurality of terminals and a tie wrap. The plurality of housing portions are mateable together to form a housing. The housing includes an attachment member. The plurality of terminals are positionable in the housing. The tie wrap has a first end and a second end. The first end is passable around the attachment member, around an electrical conduit, and can be connected to the second end to secure the electrical conduit to the housing.

Optionally, the housing includes an outer wall. The attachment member comprises a portion of the outer wall that is bordered at first and second ends by a first tie-wrap pass-through aperture and a second tie-wrap pass-through aperture respectively.

Optionally, a first face of the attachment member faces an interior of the housing and wherein the first face of the attachment member has a plurality of teeth thereon. The teeth are positioned to grip the electrical conduit when the tie wrap is tightly connected around the electrical conduit and the attachment member.

In another aspect, a kit of parts for an electrical connector, which includes a plurality of housing portions and a printed circuit board. The plurality of housing portions are mateable together to form a housing. The printed circuit board is positionable in the housing. The printed circuit board has a first face and a second face. The printed circuit board has a first electrical connection surface having a first male terminal connected thereto, and a second electrical connection surface having a second male terminal connected thereto. The first face has a third electrical connection surface for receiving a first lead from an electrical conduit, and the second face has a fourth electrical connection surface for receiving a second lead from the electrical conduit. The third and fourth connection surfaces are electrically connectable to the first and second male terminals.

In yet another aspect, a printed circuit board assembly is provided, which includes a printed circuit board and a terminal. The printed circuit board has a first face and a second face. The terminal is mounted to the printed circuit board. The terminal includes a distal portion that extends out from the printed circuit board for connection to an electrical component, and a proximal portion that has a slot therein dividing the proximal portion into a first face engaging structure and a second face engaging structure. The first face engaging structure is positioned to engage the first face of the printed circuit board and the second face engaging structure is positioned to engage the second side of the printed circuit board. One of the first and second face engagement structures includes a first engagement member and a second engagement member. The first and second engagement members are engaged with one of the first and second faces of the printed circuit board and are separated from each other by a first gap. Wherein said one of the first and second face engaging structures is electrically connected to an electrical trace on the printed circuit board via a solder connection.

Optionally, the slot has a base and wherein the first gap is generally parallel to the base of the slot.

Optionally, the distal portion is a banana plug.

Optionally, the other of the first and second face engagement structures includes a third engagement member and a fourth engagement member, wherein the third and fourth engagement members are engaged with the other of the first and second faces of the printed circuit board and are separated by a second gap.

In yet another aspect, a method of making a printed circuit board assembly is provided, comprising:

a) providing a printed circuit board having a first face and a second side;

b) providing a terminal that includes a distal portion configured for connection to an electrical component, and a proximal portion that has a slot therein dividing the proximal end into a first face engaging structure and a second side engaging structure, wherein the first face engaging structure is positioned to engage the first face of the printed circuit board and the second face engaging structure is positioned to engage the second side of the printed circuit board, and wherein one of the first and second face engagement structures includes a first engagement member and a second engagement member, wherein the first and second engagement members are separated by a first gap;

c) providing solder material on a first electrical connection surface that is on one of the first and second faces of the printed circuit board;

d) sliding the terminal onto the printed circuit board such that said one of the first and second face engagement structures slides through the solder paste such that some solder material is captured in the first gap; and e) melting and solidifying the solder material to join the terminal to the first electrical connection surface.

Optionally, the slot has a base and wherein the first gap is generally parallel to the base of the slot.

Optionally, the distal portion is a banana plug.

Optionally, the other of the first and second face engagement structures includes a third engagement member and a fourth engagement member. The third and fourth engagement members are separated by a second gap, and wherein step c) further includes providing a second amount of solder material on a second electrical connection surface that is on the other of the first and second faces of the printed circuit board, wherein step d) further includes sliding the terminal onto the printed circuit board such that the other of the first and second engagement structure slides through the solder paste on the other of the first and second faces such that some solder material is captured in the second gap, and wherein step e) further includes melting and solidifying the solder material on the other of the first and second faces to join the terminal to the second first electrical connection surface.

In yet another aspect, a kit of parts for an electrical connector is provided, and includes a plurality of housing portions, a first male terminal and a second male terminal, and a flow preventer. The plurality of housing portions are mateable together to form a housing. The first male terminal and a second male terminal are positionable in the housing. The male terminals are connectable to an electrical conduit and are positioned to connect an electrical power source to the electrical conduit. The current flow preventer positioned to prevent current flow through the electrical conduit if the polarity at the male terminals is other than the selected polarity.

In yet another aspect, a kit of parts for an electrical connector is provided and includes a plurality of housing portions, a first male terminal and a second male terminal and an output device. The plurality of housing portions are mateable together to form a housing. The first male terminal and a second male terminal. The male terminals extend from the housing and are positioned to connect to an electrical power source. The male terminals are connectable to an electrical conduit. The output device is configured to indicate whether the polarity at the male terminals is other than a selected polarity.

Optionally, the kit of parts further includes a printed circuit board positionable in the housing. The male terminals are connected to the printed circuit board. The output device is connected to the printed circuit board. The printed circuit board is connectable to an electrical conduit and is configured to electrically connect the electrical conduit to the male terminals, and contains a microprocessor that is programmed to control the output device to indicate whether the polarity at the male terminals is other than a selected polarity.

In another aspect, a kit of parts for an electrical connector, which includes a plurality of housing portions, a first male terminal and a second male terminal, and an output device. The plurality of housing portions are mateable together to form a housing. The printed circuit board positionable in the housing. The male terminals are connected to the printed circuit board and are positioned to connect to an electrical power source. The output device is connected to the printed circuit board. The printed circuit board is connectable to an electrical conduit and is configured to electrically connect the electrical conduit to the male terminals, and contains a microprocessor that is programmed to indicate via the output device at least one property of a circuit formed with the electrical connector and the electrical power source.

In another aspect, a kit of parts for an electrical connector, which includes a plurality of housing portions that are mateable together to form a housing and a printed circuit board positionable in the housing. A plurality of terminals are mounted to the printed circuit board and are configured to connection to and disconnection from an electrical power source. The printed circuit board includes a plurality of first abutment features that are engageable with a plurality of second abutment features on the housing to transfer forces to the housing during said connection to and disconnection from the electrical power source.

Optionally, the terminals have distal portions that are banana plugs.

Optionally, the first abutment features include first and second notches on the printed circuit board and the second abutment features include first and second projections on the housing.

Optionally, the first abutment features snugly engage the second abutment features to fixedly locate the printed circuit board within the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is an exploded perspective view of a kit of parts for an electrical connector in accordance with the teachings of the present disclosure;

FIG. 1*a* is a perspective view of an Anton Bauer™ connection port that is available on some video cameras;

FIG. 2 is a perspective view of a portion of a housing from the kit of parts shown in FIG. 1;

FIGS. 3*a* and 3*b* are perspective views of another portion of the housing shown in FIG. 1;

FIG. 4*a* is an exploded perspective view of portions of the housing shown in FIG. 1 with breakaway panels removed to form apertures;

FIG. 4*b* is another exploded perspective view of portions of the housing shown in FIG. 1 with only selected breakaway panels removed to form apertures;

FIG. 5 is a perspective view of a printed circuit board assembly shown in FIG. 1 with an electrical cable partially connected thereto;

FIG. 5*a* is a perspective exploded view of the printed circuit board assembly shown in FIG. 1;

Figure 1:
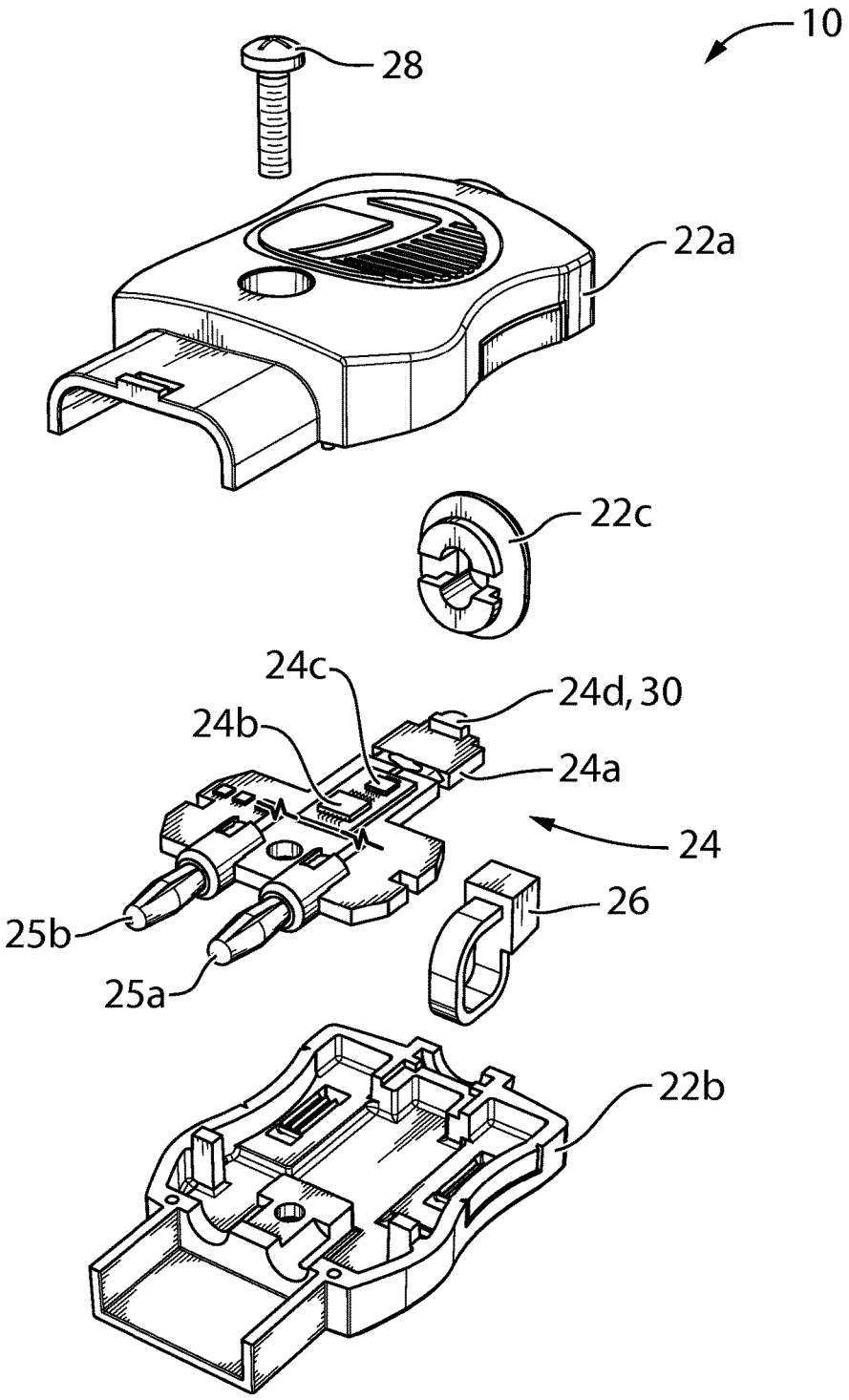
Figure 2:
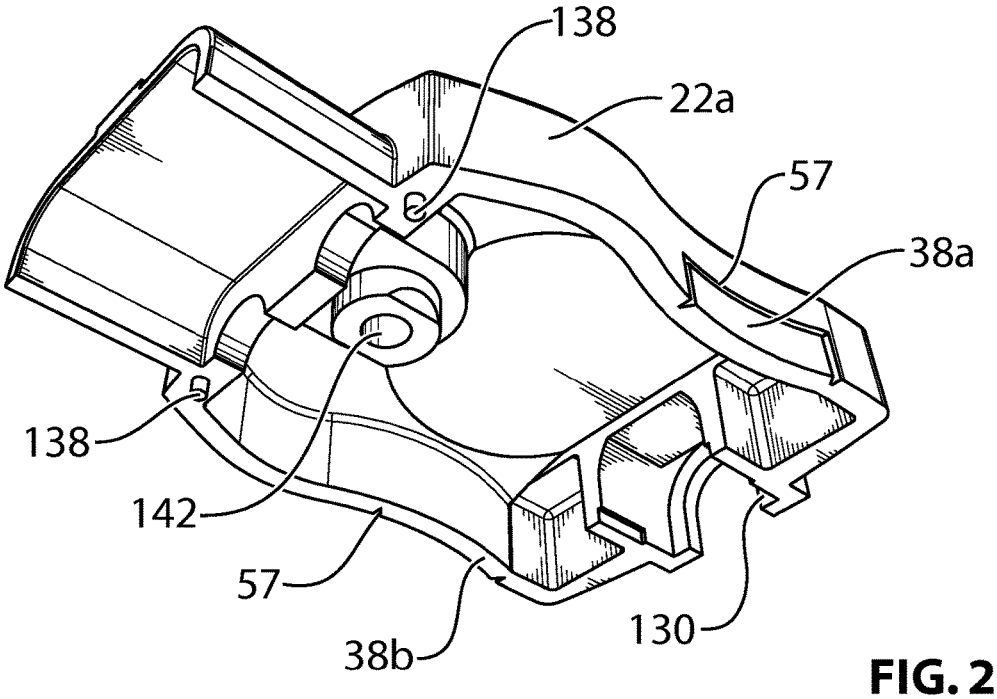
Figure 5:
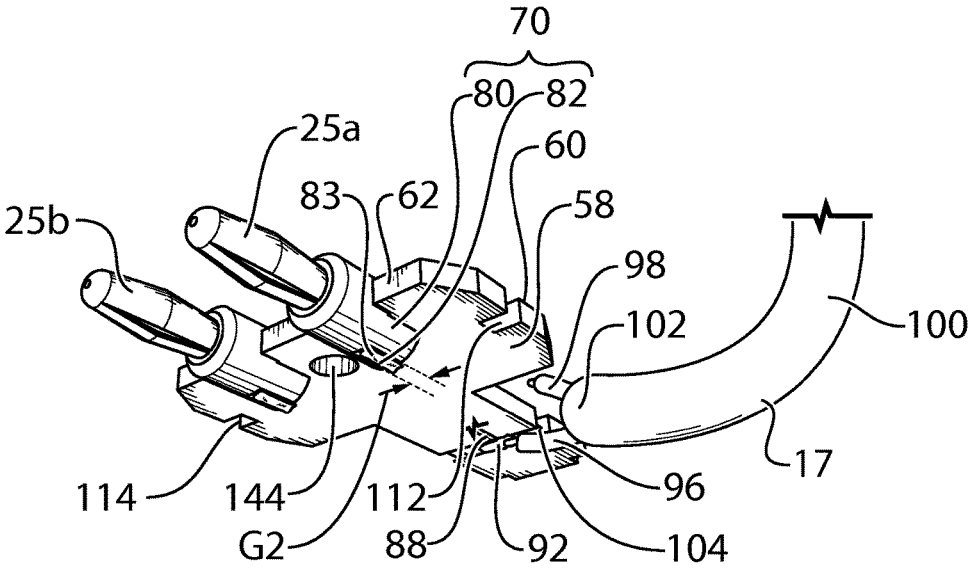
Figure 7A:
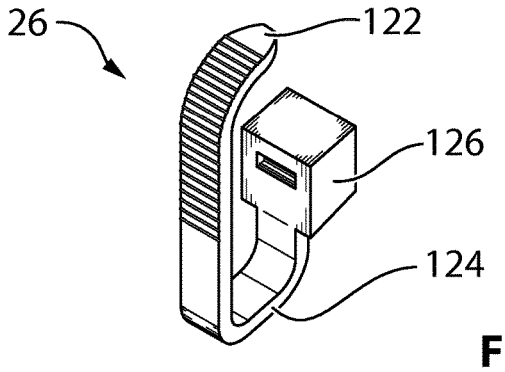
FIG. 7 is a perspective view illustrating the insertion of a tie wrap shown in FIG. 1 into the subassembly shown in FIG. 6.
Figure 7:
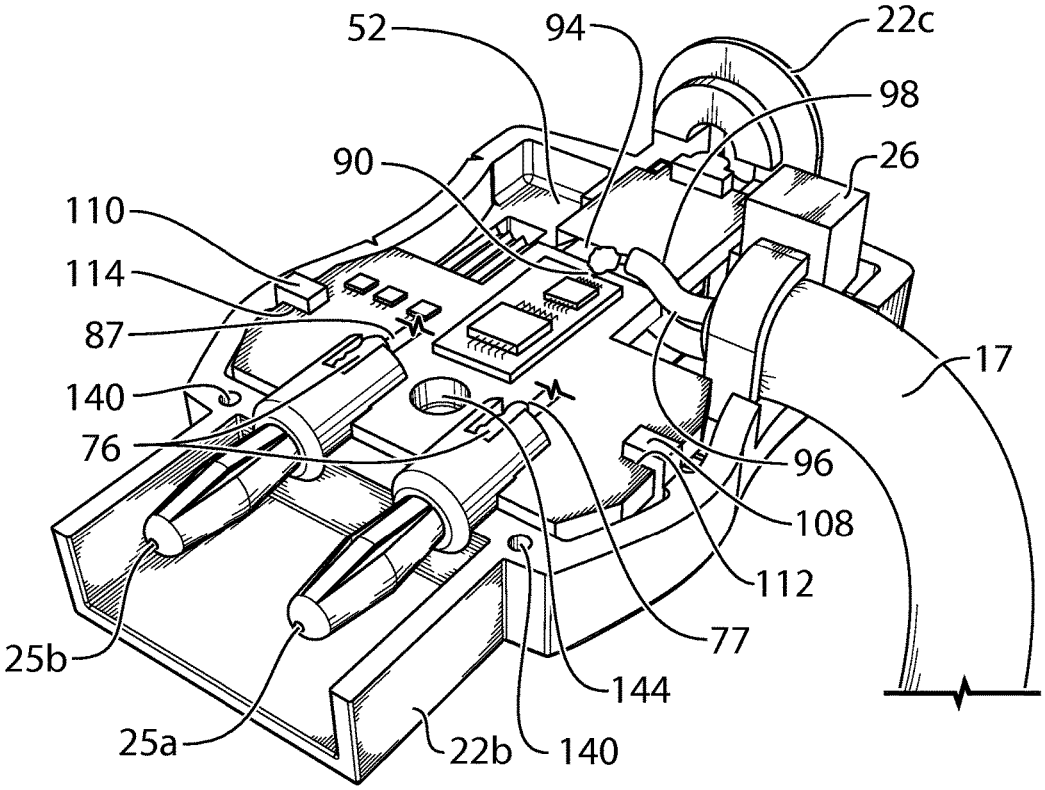
Figure 8:
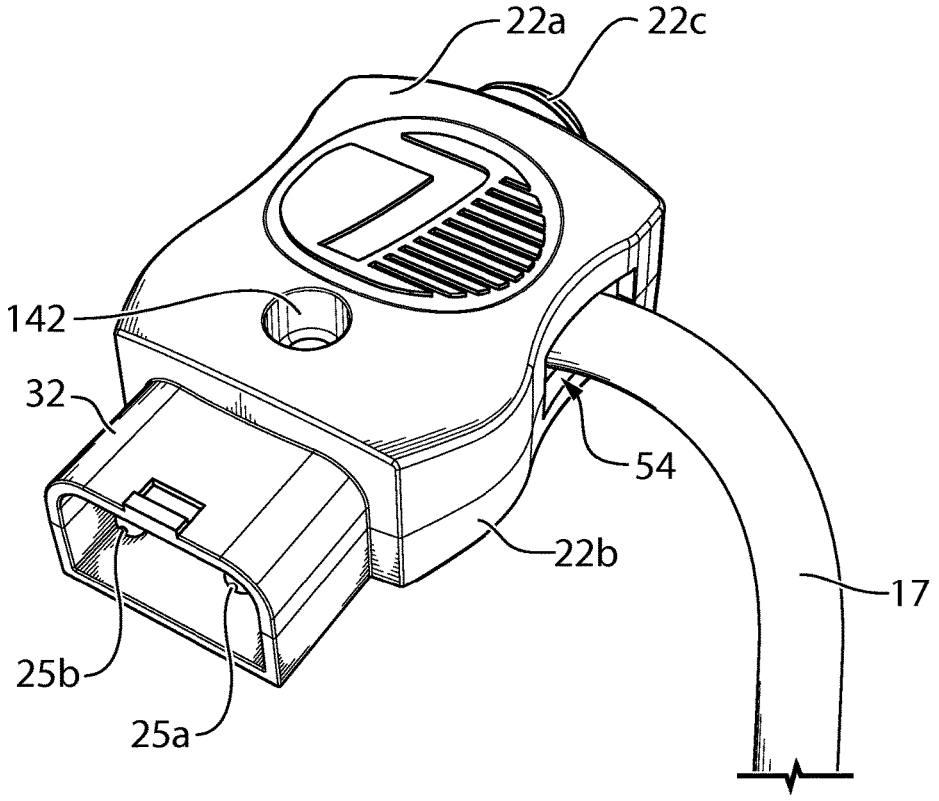
Figure 9:
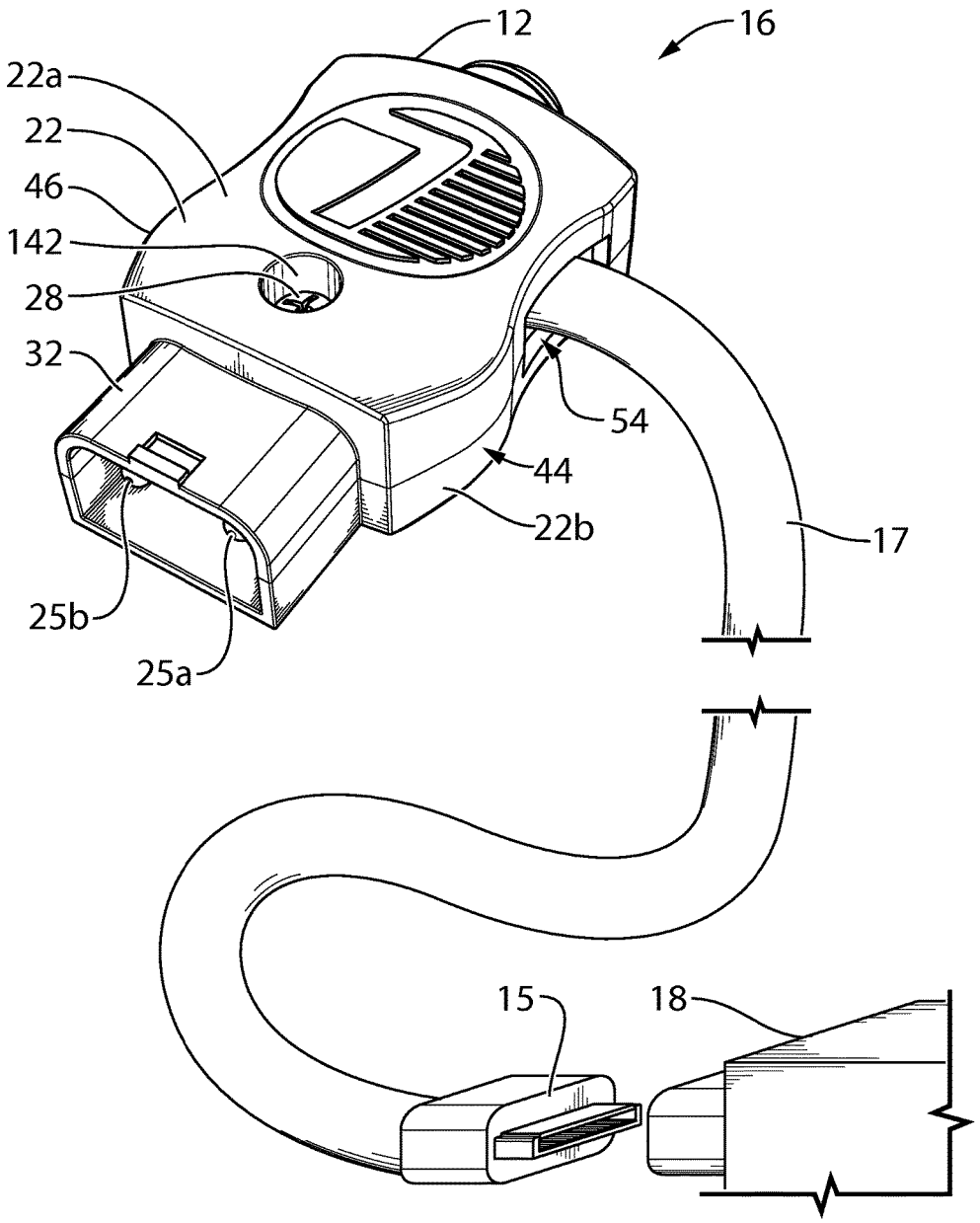
Figure 10:
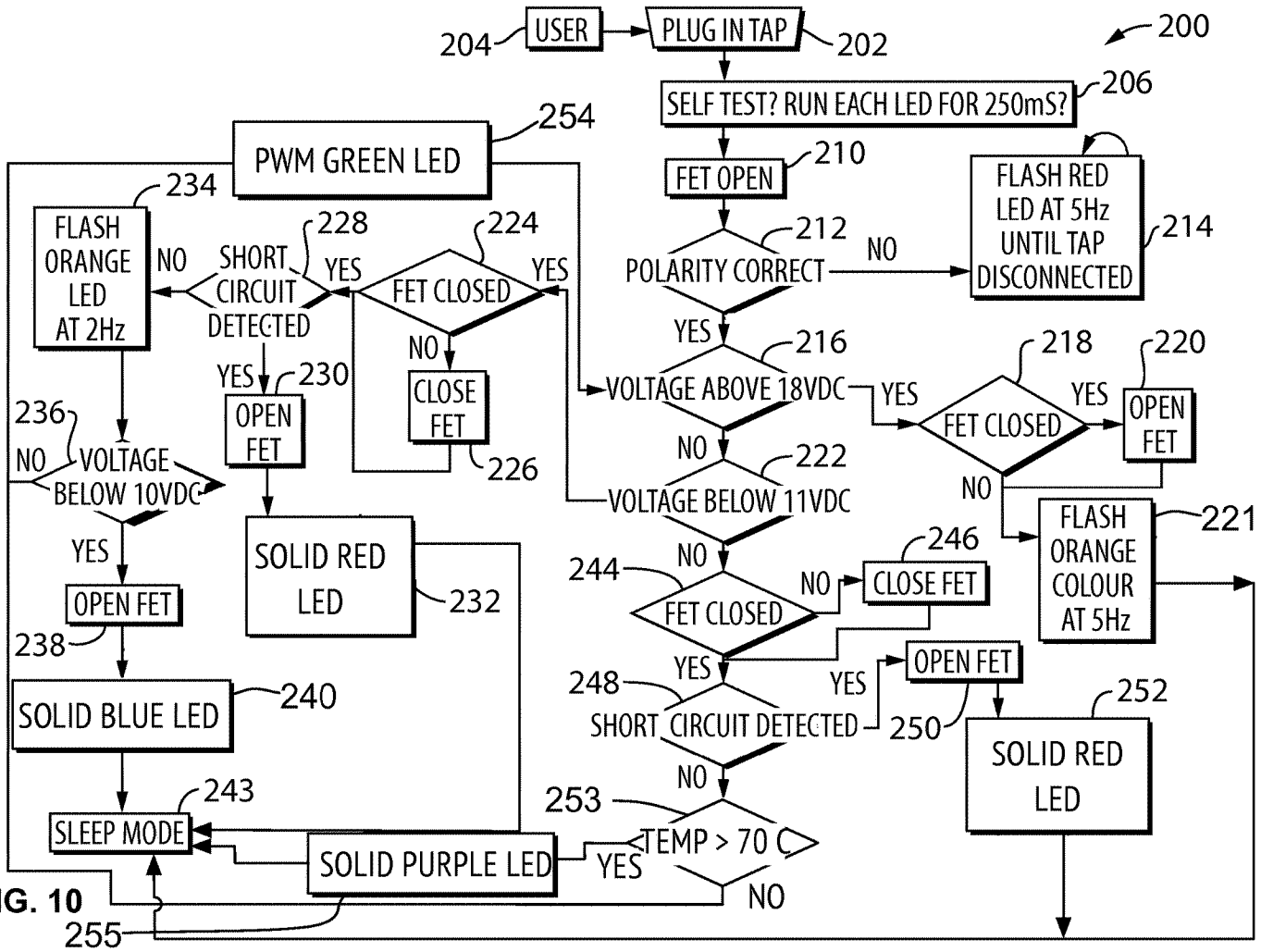
Figure 11:
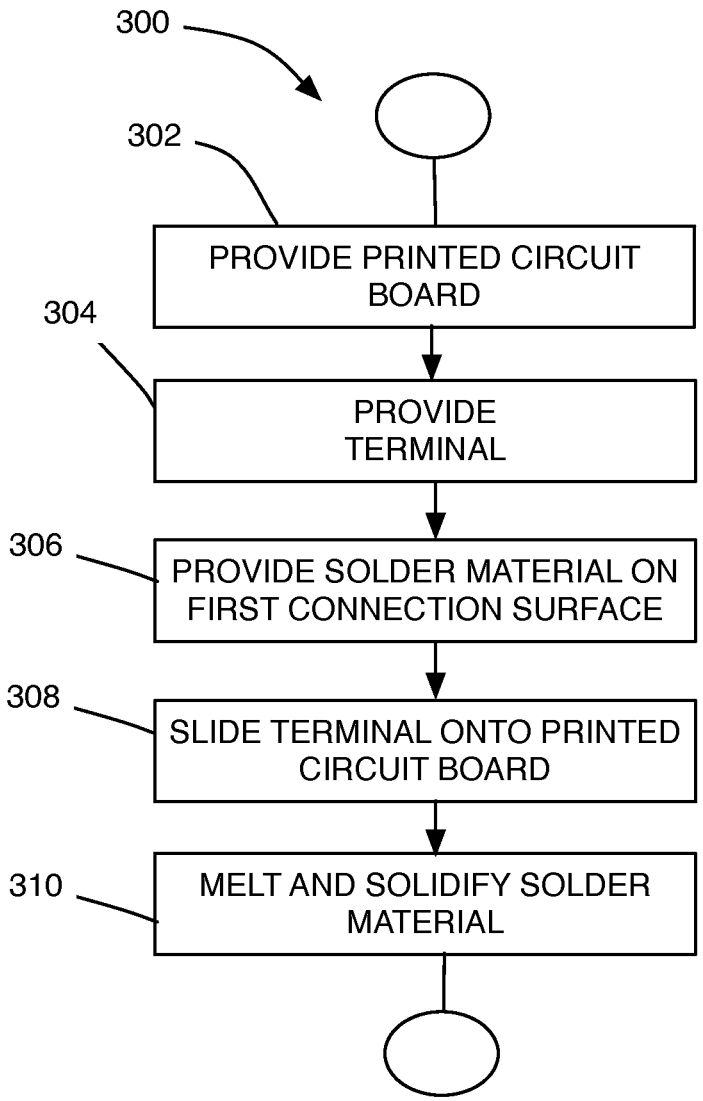

FIG. 7*a* is a perspective view of the tie wrap shown in FIG. 1 prior to tightening around the electrical cable shown in FIG. 5;

FIG. 8 is a perspective view illustrating the insertion of the housing portion shown in FIG. 2 onto the subassembly shown in FIG. 7;

FIG. 9 is a perspective view illustrating the insertion of a fastener shown in FIG. 1 into the subassembly shown in FIG. 8;

FIG. 10 is a flow diagram illustrating a method carried out by a microprocessor that is part of the printed circuit board assembly shown in FIG. 5; and FIG. 11 is a flow diagram illustrating a method of making a printed circuit board assembly.

DETAILED DESCRIPTION

Figure 1A:
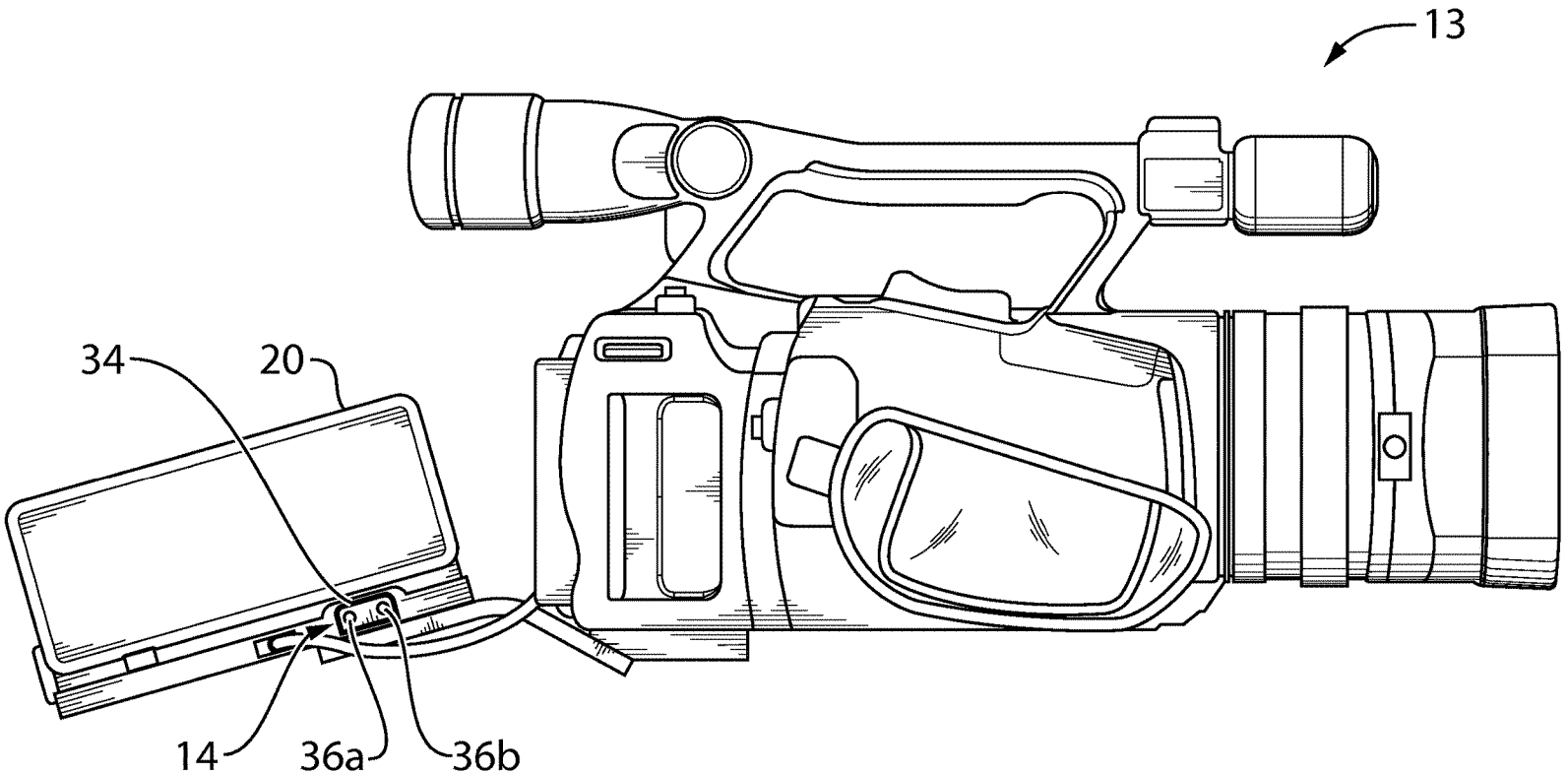

Reference is made to FIG. 1, which shows a kit of parts 10 in accordance with an embodiment of the present disclosure. The kit of parts 10 is used for forming an electrical connector 12 (FIG. 9) that is connectable to an Anton Bauer connection port shown at 14 in FIG. 1*a* on a video camera 13. The connector 12 is part of a connector assembly 16 shown in FIG. 9 that additionally includes an electric cable 17. The connector assembly 16 is used to connect an electrical device 18 to the connection port 14 so as to draw power from a power source 19 (FIG. 1*a*) for the video camera 13. The power source for the video camera 13 may be a battery pack 20 on the video camera 13, as shown in FIG. 1*a*. Alternatively, the power source could be provided via a cable connection from the video camera 13 to NC wall power.

Reference is made to FIG. 1, which shows a kit of parts 10 in accordance with an embodiment of the present disclosure. The kit of parts 10 is used for forming an electrical connector 12 (FIG. 9) that is connectable to an Anton Bauer™ connection port shown at 14 in FIG. 1*a* on a video camera 13. The connector 12 is part of a connector assembly 16 shown in FIG. 9 that additionally includes an electric cable 17. The connector assembly 16 is used to connect an electrical device 18 to the connection port 14 so as to draw power from a power source 19 (FIG. 1*a*) for the video camera 13. The power source for the video camera 13 may be a battery pack 20 on the video camera 13, as shown in FIG. 1*a*. Alternatively, the power source could be provided via a cable connection from the video camera 13 to A/C wall power.

The housing portions include a first housing portion 22*a* and a second housing portion 22*b*, that together provide the primary physical protection for the components therein, and, in the embodiment shown, a third housing portion, which is a transparent cover 22*c* used to provide a window to show a printed circuit board-mounted light-emitting diode (LED) 30 that is, in the embodiment shown, the output device 24*d*, which is inside the housing 22 when the housing 22 is fully assembled.

The housing portions 22*a* and 22*b* together form a D-shaped lip 32 (FIG. 9) that is mateable with a D-shaped surround 34 on the Anton Bauer connection port 14 (FIG. 1*a*), so as to permit the connector 12 to mount to the Anton Bauer connection port 14 in only one orientation so that the male terminals 25*a* and 25*b* are received in female terminals 36*a* and 36*b* on the connection port 14 to provide a selected current direction to a circuit formed therewith.

The housing portions 22*a* and 22*b* together form a D-shaped lip 32 (FIG. 9) that is matable with a D-shaped surround 34 on the Anton Bauer™ connection port 14 (FIG. 1*a*), so as to permit the connector 12 to mount to the Anton Bauer™ connection port 14 in only one orientation so that the male terminals 25*a* and 25*b* are received in female terminals 36*a* and 36*b* on the connection port 14 to provide a selected current direction to a circuit formed therewith.

Figure 4A:
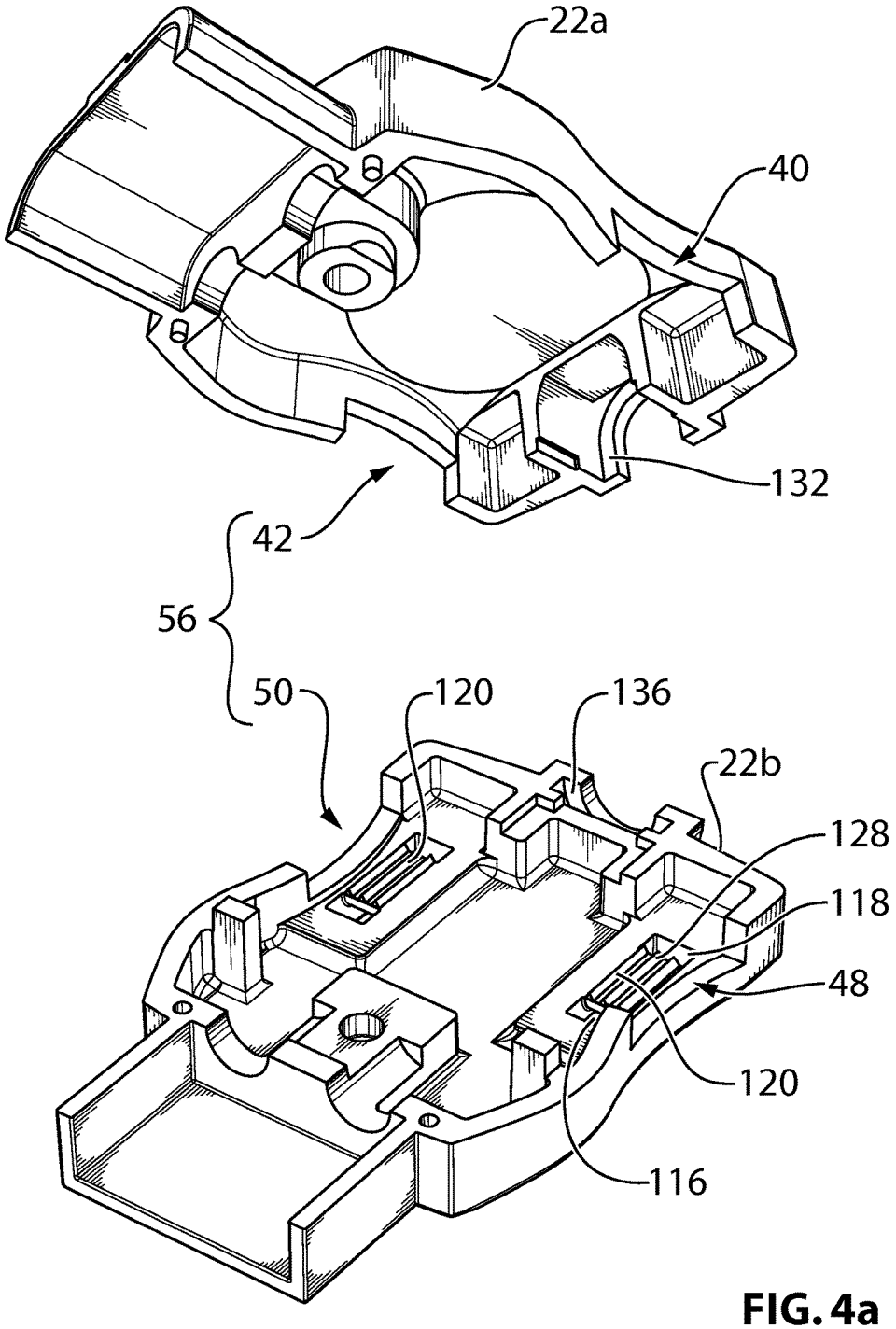
Figure 4B:
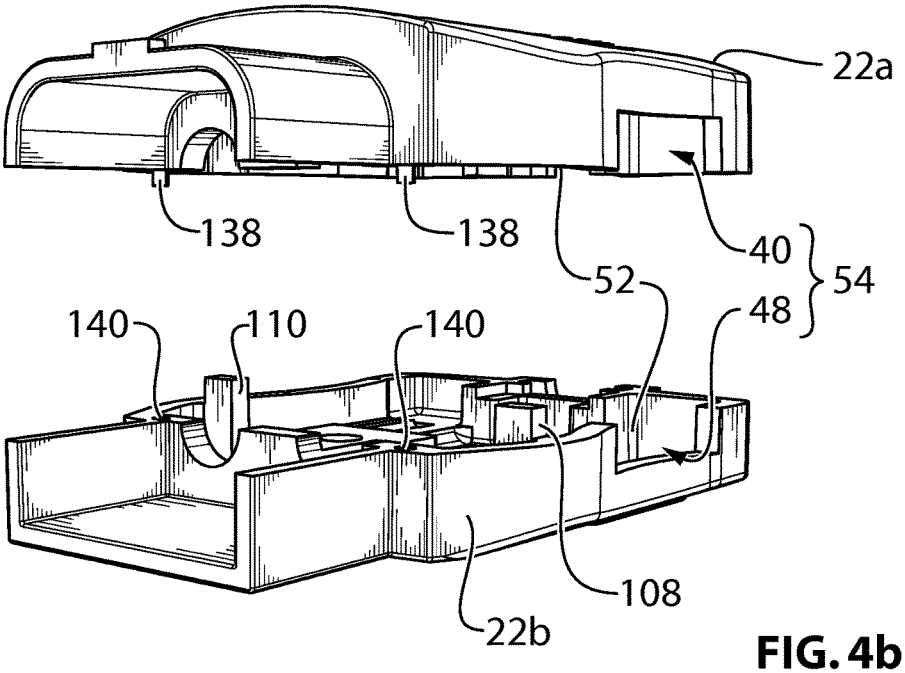

As can be seen in FIGS. 4*b*, 8 and 9, the first and third breakaway members 38*a* and 38*c* are positioned to be separable from the first and second housing portions 22*a* and 22*b* respectively so as to form a first enlarged aperture 54 when the housing portions 22*a*, 22*b* and 22*c* mate together to form the housing 22. Similarly, with reference to FIG. 4*a*, the second and fourth breakaway members 38*b* and 38*d* are positioned to be separable from the first and second housing portions 22*a* and 22*b* respectively so as to form a second enlarged aperture 56 when the housing portions 22*a*, 22*b* and 22*c* mate together to form the housing 22.

The breakaway members 38*a* and 38*b* (FIG. 2), and 38*c* and 38*d* (FIGS. 3*a*, 3*b*) may be integrally connected with the housing portions 22*a* and 22*b*, with a notch 57 separating each of the breakaway members 38*a*, 38*b*, 38*c* and 38*d* from the housing portions 22*a* and 22*b*. The notches 57 facilitate separation of the breakaway members 38*a*, 38*b*, 38*c* and 38*d* from the housing portions 22*a* and 22*b*. When assembling the connector 12, one can separate whichever breakaway members are desired so as to form an aperture on one side or the other of the housing 22 for the pass-through of the electrical conduit. In the embodiment shown, breakaway members 38*a* (FIG. 2) and 38*c* (FIGS. 3*a* and 3*b*) have been removed so as to form the first enlarged aperture 54 (FIGS. 4*b*, 8 and 9) through which the electrical conduit 17 passes. In embodiments wherein the electrical conduit 17 is smaller in diameter than that which is shown, a single breakaway member (e.g. member 38*a*) may be removed so that a smaller aperture (e.g. aperture 40) is formed. By permitting different size apertures to be formed using the breakaway members, an aperture can be provided that is sized relatively snugly around the electrical conduit, thereby inhibiting the entry of debris and the like into the interior 52 of the housing 22 during use and transport of the connector assembly 16.

A step in the assembly of the connector assembly is to separate whichever breakaway members 38*a*-38*d* (FIGS. 2, 3*a* and 3*b*) are desired. One can use a suitable tool such as pliers to grab whichever breakaway member is to be separated and to fold it or tear it from the associated housing portion 22*a* or 22*b*.

Figure 5A:
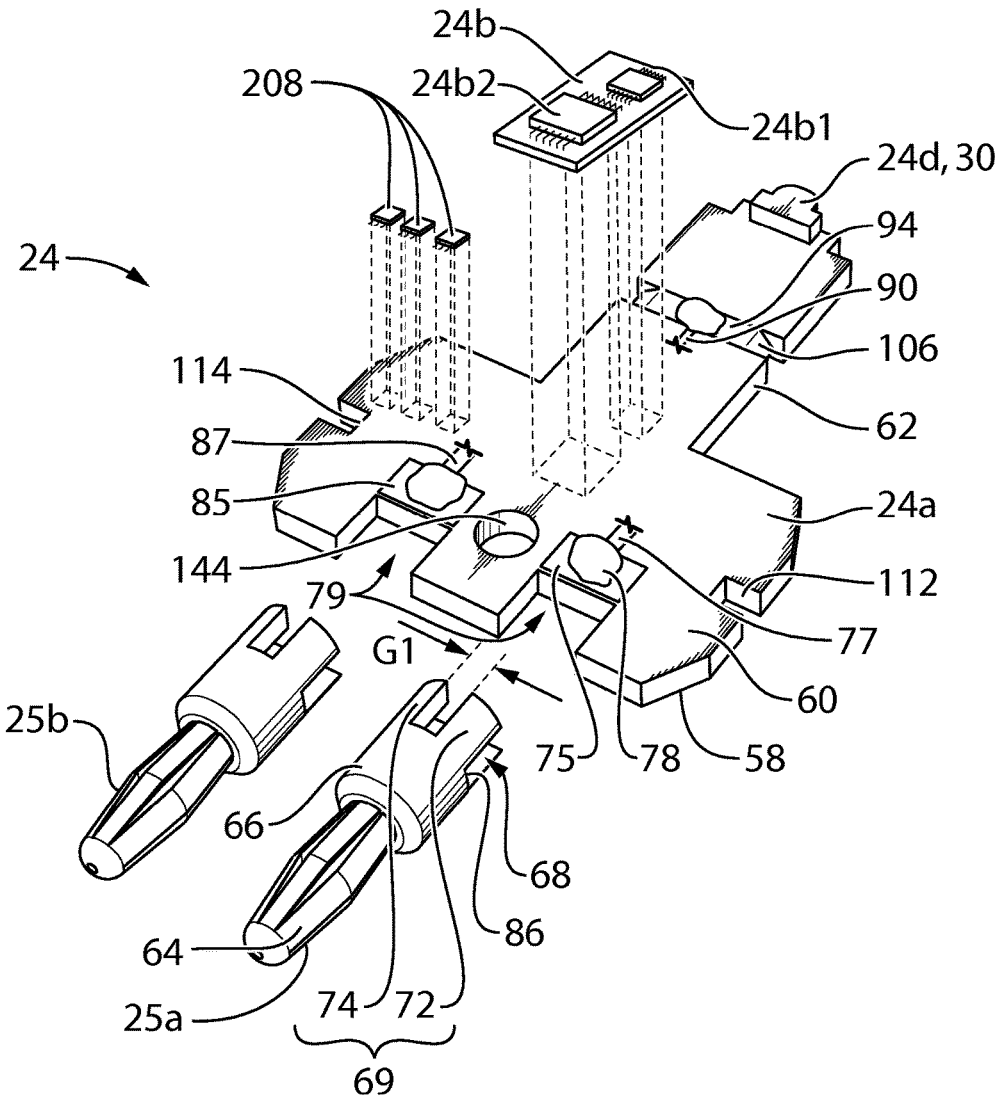

The printed circuit board assembly 24 is shown in FIG. 5*a* as an exploded view. The printed circuit board assembly 24 has a first face 58 and a second face 60 that is opposite the first face 58. In the embodiment shown, the microcontroller 24*b* is mounted onto the second face 60 of the printed circuit board 24*a* to integrate into the circuit 24*c*. The light-emitting diode (LED) 30 is mounted to the side edge shown at 62 of the printed circuit board 24*a*, but is connected electrically to electrical traces on the second face 60.

The printed circuit board 24*a* may be any suitable type of printed circuit board and may be a multi-layer configuration, including a layer of conductors on one or both of its faces and one or more layers of conductors internally.

The microcontroller 24*b* includes a memory 24*b*1 in which program code is stored, and a microprocessor 24*b*2 which is configured to execute the program code in memory 24*b*1. The microprocessor 24*b*2 and memory 24*b*1 are shown as being separate elements that are easily identifiable on the microcontroller 24*b*, however, it will be understood that this representation is for illustrative purposes only and that the actual microprocessor 24*b*2 and memory 24*b*1 may be integrated into the microcontroller 24*b* in such a way that one cannot visually discern them.

The microcontroller 24*b* may be any suitable type of microcontroller, such as, for example, known by a member of the PSoC (Programmable-System-on-Chip) family of microcontrollers provided by Cypress Semiconductor Corporation based in San Jose, Calif., USA. The microcontroller 24*b* is integrated into the circuit 24*c* for controlling the operation of the connector 12 (FIG. 9).

Figure 6:
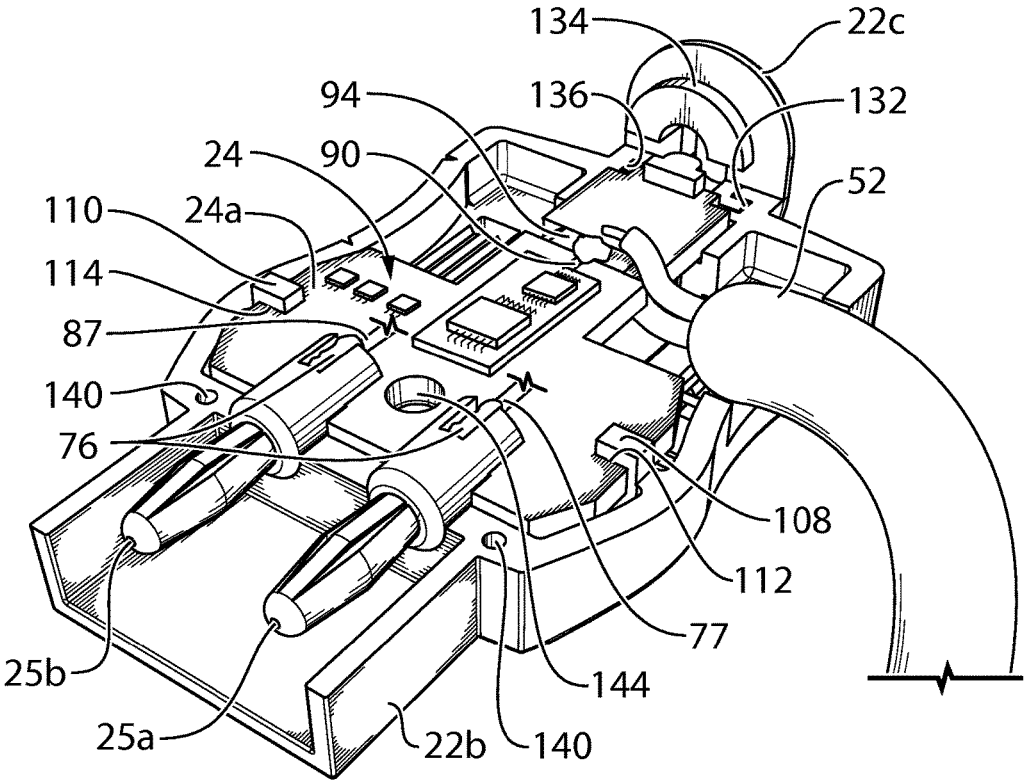
FIG. 6 is a perspective view illustrating the insertion of the printed circuit board assembly shown in FIG. 5 into the housing portion shown in FIGS. 3*a* and 3*b;*

The mounting of the terminal 25*a* is as follows, with the understanding that the mounting of the terminal 25*b* may be substantially the same. The terminal 25*a* has a distal portion 64 that extends out from the printed circuit board 24*a* for connection to an electrical component (female terminal 36*a*) and a proximal portion 66 that has a slot 68 therein dividing the proximal portion 66 into a first face engaging structure 69 and a second face engaging structure 70, which are positioned to engage the first and second faces 58 and 60 respectively of the printed circuit board 24*a*. One of the first and second face engagement structures (in the example shown, second face engagement structure 70) includes a first engagement member 72 and a second engagement member 74. The first and second engagement members 72 and 74 are separated by a first gap G1. The face engaging structure 70 is electrically connected to a first electrical connection surface 75 on the printed circuit board 24*a* via a solder connection shown at 76 in FIG. 6. Referring to FIG. 5*a*, the first electrical connection surface 75 is connected to a first electrical trace 77. An advantage of providing the gap G1 is highlighted when one considers the method of mounting the terminal 25*a* to the printed circuit board 24*a*. As an initial step a selected first amount of solder material 78 (e.g. solder paste) is deposited on the printed circuit board 12 on the first electrical connection surface 75 that is on one of the first and second printed circuit board faces 58 and 60 (in the example shown, surface 75 is on the second printed circuit board face 60). Once the solder material 78 is deposited, the terminal 25*a* is slid onto the printed circuit board 24*a* (specifically, into locating slot 79 on the printed circuit board 24*a*) such that the face engagement structure 70 slides through the first amount of solder material 78 such that some solder material 78 is captured in the first gap G1. The solder material 78 is then melted and solidified to join the terminal 25*a* to the first electrical connection surface 75, thereby forming the solder connection 76 (FIG. 6).

The above steps for mounting the terminal 25*a* may be described as steps in a method of making a printed circuit board assembly. The method is shown at 300 in FIG. 11 and includes at least: step 302 which is to provide a printed circuit board (such as printed circuit board 24*a*), step 304 which is to provide a terminal (such as terminal 25*a* or 25*b*), step 306 which is to provide solder material on the first electrical connection surface on the printed circuit board, as described above, step 308 which is to slide the terminal onto the printed circuit board as described above, and step 310 which is to melt and solidify the solder material, as described above.

In the embodiment shown, the other of the first and second face engagement structures (in this example, the first face engagement structure 69) includes a third engagement member 80 and a fourth engagement member 82. Referring to FIG. 5 the third and fourth engagement members 80 and 82 are separated by a second gap G2. The aforementioned initial step may further include providing a selected second amount of solder material on an optionally provided additional portion of the first electrical connection surface 75 that is on the other of the first and second faces 58 and 60 (in the example shown, first face 58) of the printed circuit board 24*a*. The step in which the terminal 25*a* is slid onto the printed circuit board 24*a* may further include sliding the terminal 25*a* onto the printed circuit board 24*a* such that the other of the first and second face engagement structures (in this example, structure 69) slides through the second amount of solder material 83 on the other of the first and second faces (in the example shown, face 58) such that some solder material is captured in the second gap G2. The step that includes melting and solidifying the solder material on the face 60 may further include melting and solidifying the solder material on the other of the first and second faces (e.g. face 58) to join the terminal 25*a* to the first electrical connection surface 75.

The second terminal 25*b* may connect to a second electrical connection surface 85 that connects to a second electrical trace 87 on the printed circuit board 24*a* in similar manner to how the first terminal 25*a* connects to the first electrical surface 75 and first electrical trace 77.

In the embodiment shown, the slot 68 has a base 86, and the first gap G1 is generally parallel to the base 86. In the embodiment shown, the second gap G2 is also generally parallel to the base 86. Other configurations are possible however.

In the embodiment shown, the distal portion 64 of the terminal 25*a* is male and is a banana plug, however, any other type of distal portion may be provided. For example, in an alternative embodiment the distal portion 64 may be female instead of male.

The kit of parts 10 may include the printed circuit board assembly 24 in its completed state. Alternatively one or more of the components 24*b*, 24*c*, 24*d*, 25*a* and 25*b* may be provided loose as part of the kit of parts and not premounted to the printed circuit board 24*a*.

The microcontroller 24*b* and LED 30 may be mounted to the printed circuit board 24*a* by any suitable means. Program code stored in memory 24*b*1 may be executed by the microprocessor 24*b*2 to control current flow from the first and second terminals 25*a* and 25*b* to third and fourth electrical traces shown at 88 and 90 that end at third and fourth electrical connection surfaces 92 and 94, which are provided for connection to first and second leads 96 and 98 of the electrical cable 17. A description of the program code is provided further below.

Another step in the assembly of the connector assembly 16 (FIG. 9) is shown in FIG. 5, wherein the first lead 96 from the electrical cable 17 is connected (e.g. soldered) to the third connection surface 92 on the first face 58 of the printed circuit board 24*a*.

As shown in FIG. 6, the printed circuit board 24*a* is then installed into the second housing portion 22*b*, with the electrical conduit 17 extending through the aperture 48. The printed circuit board 24*a* may be captured in the housing portion 22*b* by a pair of housing projections 108 and 110 on the housing portion 22*b* that engage snugly with a pair of notches 112 and 114 on the printed circuit board 24*a*. The engagement between the projections 108 and 110 and the notches 112 and 114 hold the printed circuit board 24*a* in place during plugging in and unplugging of the connector 12 (FIG. 9) with respect to the connection port 14 (FIG. 1*a*). This reduces stresses on the printed circuit board 24*a* and on the soldered connections of the printed circuit board 24*a* with the leads 96 and 98 during such plugging in and unplugging actions. By having snug engagement between the projections 108 and 110 and the notches 112 and 114 (as opposed to a loose engagement), the printed circuit board 24*a* is located fixedly in position in the housing 22 (FIG. 9) so that there is substantially no movement of the printed circuit board 24*a* during plugging and unplugging with respect to the connection port 14, thereby ensuring that the housing 22 absorbs all forces during plugging and unplugging and that there is no relative movement between the leads 96 and 98 and the printed circuit board 24*a* thereby protecting the soldered connections further.

As can be seen, the cable 17 has sheathing 100 that surrounds the first and second leads 96 and 98. The sheathing 100 itself passes through the aperture 48 into the interior 52 of the housing 22 for reasons described further below. As a result, there is little distance between the end of the sheathing, shown at 102, and the side edge 62 of the printed circuit board 24*a*, and thus there is little room for the leads 96 and 98 to extend from the end 102 of the sheathing 100, along the side edge 62 and onto the third and fourth electrical connection surfaces 92 and 94 respectively. As a result, without any modification of the side edge 62, there is potential for the side edge 62, in some circumstances, to cut into and damage or even sever the leads 96 and 98. In order to mitigate this risk, a first groove 104 extends from the side edge 62 to the first face 58 in a first direction that is aparallel to the side edge 62 (i.e. that is at a non-zero angle relative to the side edge 62). Additionally, a second groove 106 extends from the side edge 62 to the second face 60 in a second direction that is aparallel to the side edge 62. These first and second grooves 104 and 106 provide a path for the leads 96 and 98 to reach the first and second faces 58 and 60 without risk of damaging the leads 96 and 98. As can be seen, the printed circuit board 24*a* includes a second pair of grooves 104 and 106 on the other side to accommodate the leads 96 and 98 if the cable 17 is mounted on the other side (i.e. side 46 of the connector 12 (FIG. 9)). The electrical connection surfaces 92 and 94 extend between the two pairs of grooves 104 and 106.

The next step in the assembly process is to secure the cable 17 to the housing portion 22*b* using the tie wrap 26, as shown in FIG. 7. As can be seen in FIG. 3*b*, the housing portion 22*b* has first and second tie wrap pass-through apertures 116 and 118 which border and define a tie wrap attachment member 120. The tie wrap 26 is initially in an open configuration as shown in FIG. 7*a*, and has a first end 122 and a second end 124. A tie-wrap locking member 126 is provided at the second end 124 (which may comprises a cage with a plurality of ratchet teeth that engage corresponding ratchet teeth on the first end 122, as is commonly provided on tie wraps). The tie wrap 26 is passed through the apertures 116 and 118 (FIG. 4*b*), around the attachment member 120 and is tightened around the sheathing 100 of the cable 17 to secure the cable 17 to the housing portion 22*b* (and therefore to the housing 22), as shown in FIG. 7. In the embodiment shown, the locking member 126 of the tie wrap 26 faces the rear of the housing portion 22*b*, however this does not need to be the case.

In the embodiment shown, the attachment member 120 is simply a portion of the outer wall of the housing 22 (and of the housing portion 22*b*), as this structure is particularly strong and space efficient. However, any other suitable attachment member may alternatively be used, such as a post that projects into the interior 52 of the housing 22.

To assist the gripping of the cable 17, the housing 22 (or more specifically, the housing portion 22*b*) may include a plurality of teeth 128 on a first face 130 of the attachment member 120. The teeth 128 are positioned to grip the electrical cable 17 when the tie wrap 26 is tightly connected around the electrical cable 17 and the attachment member 120.

It will be noted that the housing portion 22*b* has an attachment member 120 with teeth 128 and apertures 116 and 118 on both sides, so as to grip the cable 17 whether the cable 17 is inserted on the right side or left side of the housing portion 22*b*.

After securing the cable 17 to the housing portion 22*b*, the second lead 98 is connected (e.g. soldered) to the fourth electrical connection surface 94, on the second face 60 of the printed circuit board 24*a*, shown in FIG. 7. Because the cable 17 is already secured in place when this step is carried out, there is no risk of accidentally pulling the connection between the first lead 96 and the connection surface 92 during this step.

After the second lead 98 is soldered, the first housing portion 22*a* is installed on the second housing portion 22*b*, as shown in FIG. 8. To locate the first housing portion 22*a* relative to the second housing portion 22*b*, The first and second housing portions 22*a* and 22*b* may include respective limit surfaces 130 and 132 (FIGS. 2 and 3*a*) that are engaged by a flange 134 (FIG. 6) on the LED window 22*c*. The limit surface 132 is part of a slot 136 (FIG. 3*a*) that receives the flange 134 (FIG. 6) that fixedly holds the LED cover 22*c* in place on the second housing portion 22*b*.

Figure 3A:
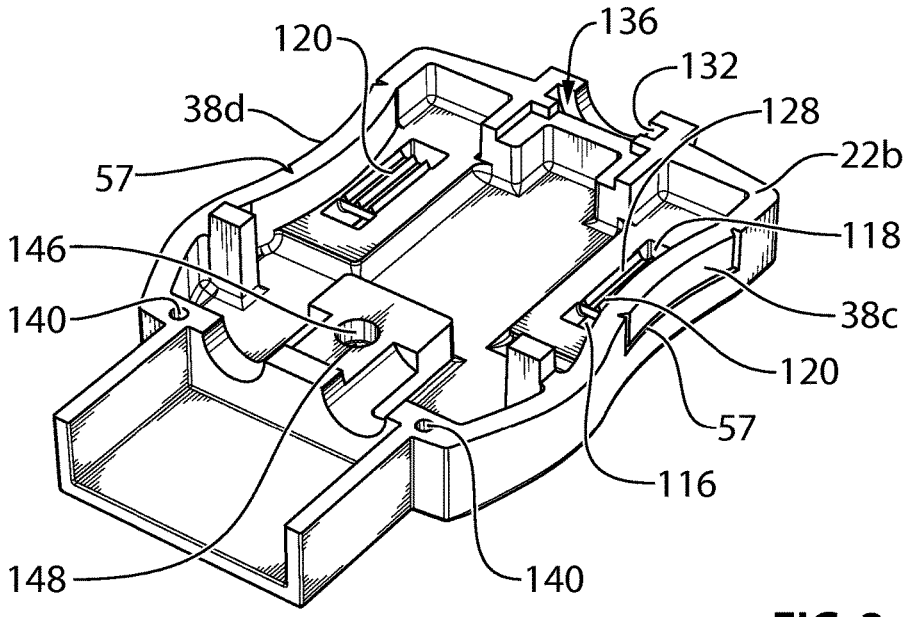
Figure 3B:
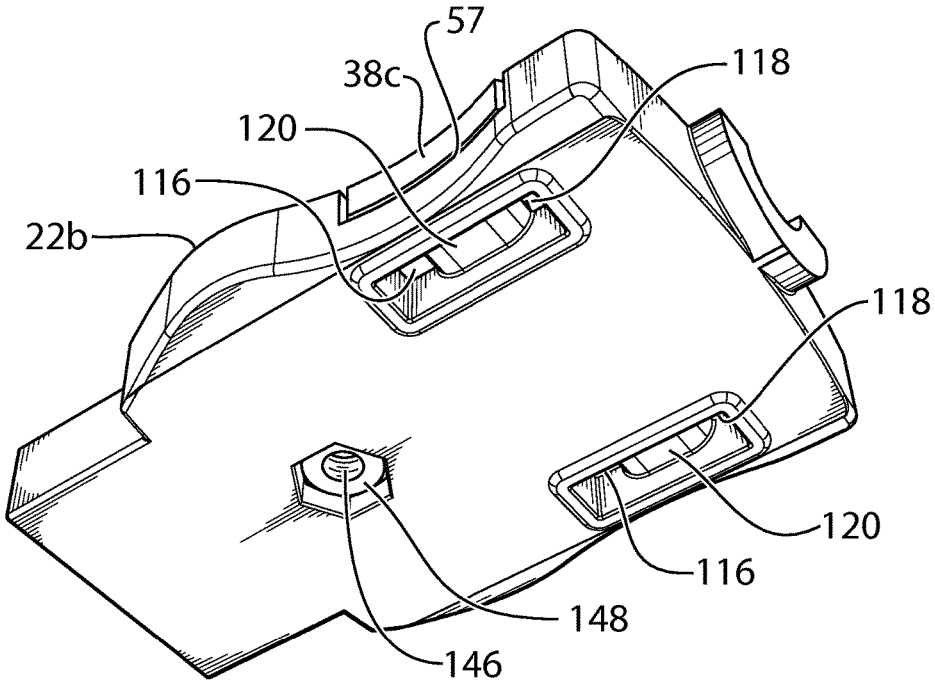

Optionally, as shown in FIGS. 2 and 3*a*, the first and second housing portions 22*a* and 22*b* may also include other locating means, such as projections 138 on the first housing portion 22*a* that engage apertures 140 on the second housing portion 22*b*. Alternatively the projections and apertures may be omitted, however.

Once the first housing portion 22*a* is installed on the second housing portion 22*b*, the fastener 28 may be inserted into the apertures shown at 142 in the first housing portion 22*a*, 144 through the printed circuit board 24*a*, 146 in the second housing portion 22*b*, to engage a nut 148 that is held in the second housing portion 22*b* (e.g. by press-fit). The second housing portion 22*b* may be provided with the nut 148 already therein so as to reduce the number of loose items in the kit of parts 10, or alternatively, the nut 148 may be provided loose, for the user to insert into place in the second housing portion 22*b*. Once the fastener 28 is installed, the connector assembly 16 is complete, as shown in FIG. 9.

Reference is made to FIG. 10, which illustrates a method of operation of the electrical connector assembly that is carried out by the microcontroller 24*b*. As can be seen in FIG. 10, the method is shown at 200. With reference to FIG. 10, as well as FIGS. 1-9, the method 200 includes step 202 in which a user 204 plugs in the connector assembly 16 (FIG. 9) to a connection port 14 (FIG. 1*a*). Optionally, a step 206 is carried out in which the microcontroller 24*b* illuminates each LED 30 (in this example there is only one LED 30) for a brief period of time (e.g. 250 ms) to indicate that the LED 30 is functioning properly.

One or more FETs, (field effect transistors), shown at 208 in FIG. 5*a*, may be provided to control the flow of current to the electrical device 18. In the embodiment shown three FETs 208 are provided. Initially, the FETs 208 in the circuit 24*c* are kept open, at step 210. With the FETs 208 open, a number of checks are performed by the microcontroller 24*b*. At step 212 the microcontroller 24*b* checks if the polarity is correct. If the polarity is not correct (i.e. if the connection to the connection port 14 is reversed), then the microcontroller 24*b* outputs a signal indicating the reversed polarity at step 214. For example, the microcontroller 24*b* may cause the LED 30 to illuminate in red at 5 Hz until the connector assembly 16 is disconnected from the connection port 14.

If the connection is correct (i.e. if the polarity is correct), then, at step 216 the microcontroller 24*b* checks whether the voltage is above a selected maximum permitted voltage, which indicates an overvoltage condition that could damage the device 18. For example, the selected maximum permitted voltage may be 18 VDC. If the voltage is above 18 VDC then the microcontroller 24*b* checks whether the FETs 208 are closed at step 218. If the FETs 208 are closed, then the FETs 208 are opened at step 220. If the FETs 208 are already open (or after the FETs 208 are opened at step 220) the microcontroller 24*b* outputs a signal indicating the overvoltage condition at step 222. For example, the microcontroller 24*b* may cause the LED 30 to illuminate in orange at 5 Hz at step 221 for a period of time (e.g. 5 minutes) after which the connector assembly 16 may enter a sleep mode at step 243.

If the voltage is not above the maximum permitted voltage, then, at step 222 the microcontroller 24*b* checks whether the voltage is below a selected minimum permitted voltage, which indicates that an undervoltage condition is approaching. An undervoltage condition is indicative that the charge level of the battery pack (in situations where a battery pack is the power source 20) is so low that further discharge of the battery pack 20 could damage the battery pack in a way that impacts the inability for the battery pack 20 to fully charge thereafter. The selected first minimum permitted voltage may be any suitable value, such as, for example, 11 VDC. If the voltage is below 11 VDC then the microcontroller 24*b* checks whether the FETs 208 are closed at step 224. If the FETs 208 are not closed, then the FETs 208 are closed at step 226. If the FETs 208 are already closed (or after the FETs 208 are closed at step 226) the microcontroller 24*b* checks whether a short circuit is detected at step 228 (e.g. by determining whether the current in the circuit is above a selected maximum permitted current, such as, for example, 8 Amps). If a short circuit is detected, then the microcontroller 24*b* opens the FETs 208 at step 230, and outputs a signal indicating that a short circuit condition exists at step 232. For example, the microcontroller 24*b* may illuminate the LED 30 in solid red until the connector assembly 16 is disconnected from the connection port 14 or until the device 18 is disconnected from the connector assembly 16 if the device 18 is the source of the short circuit.

If, at step 228 the microcontroller 24*b* does not detect a short circuit, the microcontroller 24*b* may permit the FETs 208 to remain closed (thereby connecting the device 18 electrically to the battery pack 20 (FIG. 1*a*)), but may output a signal indicating a low voltage warning condition at step 234 (e.g. by causing the LED 30 to flash orange at 2 Hz). The microcontroller 24*b* continues to check the voltage however to determine whether the voltage falls below 10 VDC (or some other selected minimum permitted voltage) at step 236, which is indicative that an undervoltage condition exists. If the voltage does fall below this other selected minimum permitted voltage, then the microcontroller 24*b* may open the FETs 208 at step 238 so as to prevent current flow to the device 18, and may output a signal indicating the second low (below 10 VDC) voltage condition at step 240 (e.g. by causing the LED 30 to illuminate as solid blue). The microcontroller 24*b* continues to cause the LED 30 to glow solid blue for some period of time (e.g. 5 minutes) at which point the connector assembly 12 enters sleep mode at step 243.

Worded in another way (and more broadly in at least some senses), the microcontroller 24*b* (FIG. 5*a*) may be configured to sense a voltage related to a voltage from the battery pack 20 (FIG. 1*a*) in embodiments wherein the power source 20 is a battery pack, and to prevent a flow of current from the electrical power source 20 to the electrical conduit 17 (FIG. 9) if the sensed voltage is below a selected first minimum permitted voltage (e.g. 10 VDC). Additionally or alternatively the microcontroller 24*b* may be programmed to control the output device (e.g. LED 30) to indicate that there is an undervoltage condition present. The microcontroller 24*b* may also be programmed to output a signal to an output device (e.g. LED 30) to indicate if the sensed voltage is below a selected second minimum permitted voltage that is higher than the selected first minimum voltage (e.g. 11 VDC), to notify a user that an undervoltage condition is approaching.

If the voltage is determined to not fall below 11 VDC at step 222, then the microcontroller 24*b* may check if the FETs 208 are closed at step 244, and if the FETs 208 are open, the microcontroller 24*b* may close it at step 246, thereby connecting the device 18 to the battery pack 20. If the FETs 208 are already closed at step 244 (or once they are closed at step 246) the microcontroller 24*b* checks whether a short circuit is detected at step 248 (e.g. by determining whether the current is above a selected maximum permitted circuit). If a short circuit is detected, then the microcontroller 24*b* may open the FETs 208 at step 250 and may output a signal indicating that a short circuit condition exists (e.g. by illuminating the LED 30 solid red) for a period of time (e.g. 5 minutes) at which point the connector assembly 16 enters the sleep mode at step 243.

If no short circuit is detected at step 248, the microcontroller 24*b* may check at step 253 to determine whether there is an overtemperature condition at some point in the circuit, which indicates that some point in the circuit (e.g. the temperature of the microprocessor 24*b*2) has a temperature that is greater than a selected maximum permitted temperature, such as 70 degrees C. This overtemperature condition may be sensed using any suitable means, such as by an on-die thermal sensor that is associated with the microprocessor. By setting the maximum permitted temperature to a value that ensures that the elements of the connector 12, such as the microcontroller 24*b*, the memory 24*c*, the LED 30 and other components, do not overheat and incur damage, an inexpensive way is provided for protecting the connector 12 against such an event. If an overtemperature condition is determined to exist, then the microcontroller 24*b* may indicate this (e.g. by illuminating the LED 30 solid purple) and may send the connector 12 into the sleep mode at step 243.

If an overtemperature condition is not determined to exist, then the microcontroller 24*b* may be programmed to output a signal indicative of a healthy circuit between the device 18 and the battery pack 20 at step 254, (e.g. by illuminating the LED 30 to be green). In some embodiments, the microcontroller 24*b* may, using PWM, cause the LED 30 to flash at a selected frequency (e.g. 1 Hz) with a selected duty cycle. A healthy circuit, in the example described above, means that the voltage at the first and second terminals 25*a* and 25*b* is within a selected range (e.g. between 11-18 VDC), that no short circuit is detected and that the polarity of the connection is not reversed. In some embodiments, the microcontroller 24*b* may not be programmed/configured to check for one or more of these aforementioned conditions (overvoltage, undervoltage, short circuit, polarity reversal, overtemperature). In such embodiments, the microcontroller 24*b* could instead monitor some other property or condition of a circuit that is considered to be determinative of whether the circuit is healthy.

Once a healthy circuit is determined to exist, control may then be sent back to step 216 wherein the microcontroller 24*b* checks again for an overvoltage condition. As can be seen in FIG. 10, it will be noted that, if at step 236 the voltage is determined not to be below the second minimum voltage, the microcontroller 24*b* may also send control back to step 216 where an overvoltage condition is checked.

While the above method 200 has been shown to be operated in a certain sequence of steps, it will be understood that the order of the steps may be changed from what is shown in FIG. 10. For example, it is possible that the undervoltage condition can be checked before the overvoltage condition is checked. It will further be noted that some steps are optional. It is possible, for example, that no check is made if a selected time period has elapsed if the voltage falls below the second low voltage (e.g. 10 VDC).

It will also be understood that the colours and frequencies selected for the LED 30 under different conditions may be changed. Indeed the output device need not be an LED 30 at all; the output device could instead be some other device, such as, for example, a speaker.

It will be understood, that, while specific hardware is not shown for carrying out some of the steps of the method 200, it will be apparent to one skilled in the art how to carry out these steps, such as checking the voltage for an overvoltage condition or an undervoltage condition.

For example, in an embodiment, a diode may be provided to prevent current flow in a situation where the polarity has been reversed due to connecting the connector 12 (FIG. 9) backwards on the port 14 (FIG. 1*a*). Thus, instead of FETs being provided to act as the current flow preventer, the diode may be provided as the current flow preventer. Alternatively, the diode may form part of a current flow preventer along with the FETs in embodiments where both the diode and the FETs are provided.

Regardless of what component or components are provided to prevent current flow in the event of a reverse polarity event, those components that make up the current flow preventer (e.g. the diode) need not be internal to the housing 22. They could be external to the housing 22.

While it has been shown and described for the kit of parts 10 to include printed circuit board assembly 24, with a printed circuit board 24*a* and a microprocessor 24*b* (and other components), it is alternatively possible for the kit of parts 10 to provide an output device, such as the LED 24*d* that is part of a circuit that does not include a printed circuit board or microprocessor. In other words, any other suitable circuit and structure may be provided for controlling the output device (e.g. the LED 24*d*) may be provided to indicate to a user that there is a reverse polarity event (i.e. that the polarity of the circuit is other than a selected polarity).

It will be understood that, when it is stated that the microcontroller 24*b* is programmed or configured to carry out a certain task, it is the microprocessor 24*b*2 specifically that is programmed or configured to carry out the task.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed:

1. A kit of parts for an electrical connector, comprising:

a plurality of housing portions that are matable together to form a housing having a shape that is connectable to a D-tap connector from an electrical power source;

a first male terminal and a second male terminal that are positionable in the housing to connect the electrical power source to the electrical conduit when the housing is connected to the D-tap connector from an electrical power source;

a current flow preventer located between the first and second male terminals and electrical conduit and inside the housing, and positioned to prevent current flow through the electrical conduit when the polarity at the male terminals is other than a selected polarity;

an output device configured to indicate whether the polarity at the male terminals is other than the selected polarity; and a printed circuit board positionable in the housing, wherein the male terminals are connected to the printed circuit board, and wherein the output device is connected to the printed circuit board, wherein the printed circuit board is connectable to the electrical conduit and is configured to electrically connect the electrical conduit to the male terminals, and contains a microprocessor that is programmed to control the output device to indicate whether the polarity at the male terminals is other than the selected polarity.

2. A kit of parts as claimed in claim 1, wherein the output device is a light-emitting diode (LED).

3. A kit of parts as claimed in claim 1, wherein the output device is a multicolour light-emitting diode (LED).

4. A kit of parts as claimed in claim 1, wherein the microprocessor is programmed to indicate via the output device at least one condition selected from a group of conditions consisting of: whether the voltage at the first and second male terminals is above a selected maximum permitted voltage, whether the voltage at the first and second male terminals is below a selected minimum permitted voltage, whether the voltage at the first and second male terminals is within a selected range of permitted voltages, whether the current is above a selected permitted current, and whether the temperature in the circuit is above a selected maximum permitted temperature.

5. A kit of parts as claimed in claim 4, wherein the microprocessor is programmed to prevent current flow between the male terminals and the electrical power source based on a determination by the microprocessor of at least one condition selected from the group of conditions consisting of: whether the voltage at the first and second male terminals is above a selected maximum permitted voltage, whether the voltage at the first and second male terminals is below a selected minimum permitted voltage, whether the current is above a selected maximum permitted current and whether the temperature in the circuit is above a selected maximum permitted temperature.

6. A kit of parts as claimed in claim 5, wherein the selected minimum permitted voltage is a first selected minimum permitted voltage that is indicative of an undervoltage condition, and wherein the microprocessor is further programmed to indicate via the output device if the sensed voltage is below a second selected minimum permitted voltage, to notify a user that an undervoltage condition is approaching.

7. A connector assembly, comprising:

a plurality of housing portions mated together to form a housing shaped to connect to a D-tap connector from an electrical power source;

an electrical conduit that extends from the housing, wherein the electrical conduit is connectable directly to an electrical device;

a first male terminal and a second male terminal positioned in the housing to connect the electrical power source to the electrical conduit when the housing is connected to the D-tap connector from the electrical power source; and a current flow preventer located between the first and second male terminals and electrical conduit and inside the housing, and positioned to prevent current flow through the electrical conduit if the polarity at the male terminals is other than a selected polarity;

a printed circuit board positioned in the housing, an output device connected to the circuit board and configured to indicate whether the polarity at the male terminals is other than the selected polarity; and wherein the male terminals are connected to the printed circuit board, and wherein the output device is connected to the printed circuit board, wherein the printed circuit board is connectable to an electrical conduit and is configured to electrically connect the electrical conduit to the male terminals, and contains a microprocessor that is programmed to control the output device to indicate whether the polarity at the male terminals is other than the selected polarity.

* * * * *